US006209868B1

(12) United States Patent
Norton

(10) Patent No.: US 6,209,868 B1
(45) Date of Patent: Apr. 3, 2001

(54) ARTICLE DISPENSER COMPRISING A GAME OF CHANCE

(76) Inventor: David A. Norton, 4910 W. Linbaugh, Tampa, FL (US) 33624

( * ) Notice: Subject to any disclaimer, the term of this patent is extended or adjusted under 35 U.S.C. 154(b) by 0 days.

(21) Appl. No.: 09/437,856

(22) Filed: Nov. 10, 1999

(51) Int. Cl.[7] ..... A63B 7/02

(52) U.S. Cl. ..... 273/118 R; 273/123 R; 273/138.3; 273/138.4

(58) Field of Search ..... 273/108, 118 R, 273/118 A, 118 D, 119 R, 119 A, 121 R, 121 A, 121 D, 123 R, 123 A, 124 R, 124 A, 125 R, 125 A, 138.1, 138.2, 138.3, 138.4, 139; 221/92, 199

(56) References Cited

U.S. PATENT DOCUMENTS 3,476,391 * 11/1969 Fejko ..... 273/124 R
5,722,656 3/1998 Dickerson .
5,988,637 * 11/1999 Dickerson ..... 273/118 R
6,062,560 * 5/2000 Peterson ..... 273/118 R

* cited by examiner

*Primary Examiner*—Raleigh W. Chiu
(74) *Attorney, Agent, or Firm*—David Kiewit

(57) ABSTRACT

A vending machine is combined with a game of skill and chance. A ball or other generally spherical item of merchandise is dispensed onto an intermediate carrier each time the player deposits an adequate amount of money. The player causes the ball to be ejected from the carrier, which may simulate a dump truck, onto an upper portion of a slanted playing surface and attempts to cause the ball to contact a target as it rolls down the slanted playing surface. The apparatus awards a prize or a prize credit of some sort if a target is struck, and, in some versions, may aggregate credits for multiple games. Whether or not the ball strikes the target, it eventually falls into a delivery chute from which the player can retrieve it.

22 Claims, 6 Drawing Sheets

ARTICLE DISPENSER COMPRISING A GAME OF CHANCE

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The invention relates to article dispensing machines, and in particular to article dispensing apparatus in which a dispensed article is used as a playing piece in a game of skill or chance before being delivered to a buyer.

2. Background Information

Vending machines are well known for dispensing novelty items stored in generally spherical or egg-shaped containers, and for dispensing a variety of balls which may be rubber toys, hard candy or candy-coated chewing gum balls, etc. One commonly finds several such machines, each displaying items of merchandise stored in a transparent hopper, grouped together in a row to provide the customer with a selection of products.

It is also known to use an item being vended as a playing piece in a game of skill or chance in which the customer or player is awarded additional merchandise or some other prize in response for a successful play. An extensive discussion of such apparatus is provided by Dickerson in U.S. Pat. No. 5,772,656. In that reference Dickerson teaches a pinball-like game in which the playing piece, which may be a gum ball or some sort of generally spherical container holding an item of merchandise, is delivered to the player on each play. The disclosure of Dickerson in U.S. Pat. No. 5,772,656 is herein incorporated by reference.

BRIEF SUMMARY OF THE INVENTION

The invention provides apparatus combining a vending machine with a game of skill and chance in which a "ball", as hereinafter defined, is vended to a player each time the player deposits an adequate amount of money, tokens, or the like. In preferred apparatus of the invention, the vended ball is visibly dropped from a hopper onto an intermediate carrier whence the player causes the ball to be ejected onto an upper portion of a slanted playing surface. The player attempts to control the ejection so that as the ball rolls down the slanted playing surface it strikes or falls into a target, which leads to the apparatus awarding a prize or a prize credit of some sort or another. Whether or not the ball strikes the target, the ball eventually falls into a delivery chute from which the player can retrieve it.

In one preferred embodiment the intermediate carrier simulates a dump truck, train, or other cargo vehicle from which loads are customarily dumped. This carrier may be in constant horizontal reciprocating motion behind a front window of the apparatus whenever the apparatus is available for play. In preferred apparatus of this sort an item is vended into the simulative vehicle, which then resumes its reciprocating motion until the player hits a "Dump" button or the like, at which time the simulative vehicle stops and dumps the vended ball onto the top of the slanted playing surface.

In another preferred embodiment the intermediate carrier comprises a preferably circular rotatable surface partially surrounded by an upstanding wall or collar arranged to guide the ball towards an upper portion of a slanted playing surface. In apparatus of this sort an item is vended onto the rotatable surface, after which the player spins the rotatable surface so as to fling the item onto a slanted playing surface. In particular preferred embodiments of this sort, the slanted playing surface is tilted only slightly away from a horizontal orientation and means are provided to the player to shake and jostle the slanted surface in order to move the ball thereabout.

It is a further feature of some embodiments of the invention to provide apparatus that vends a selected item each time a player deposits a predetermined payment, that provides a game of skill and chance played with the vended item during the course of its delivery, that awards and accumulates credits for successful play or plays of the game, and that delivers a player-selected prize (where the prize is an actual item of merchandise rather than being a ticket or other credit-indicating means redeemable by a game operator) that is one of several displayed prizes corresponding to the player's accumulated credit.

Although it is believed that the foregoing recital of features and advantages may be of use to one who is skilled in the art and who wishes to learn how to practice the invention, it will be recognized that the foregoing recital is not intended to list all of the features and advantages. Moreover, it may be noted that various embodiments of the invention may provide various combinations of the hereinbefore recited features and advantages of the invention, and that less than all of the recited features and advantages may be provided by some embodiments.

DETAILED DESCRIPTION OF THE INVENTION

The invention provides several arrangements in which an item of merchandise is delivered to a player after the item rolls along a slanted playing surface. These vended items may themselves be spherical or quasi-spherical, or may be packaged in spherical, quasi-spherical, or ovoid packages. These vended items and their packaging, if used, are hereinafter referred to as "balls" 8. Candy-coated gum balls are generally nearly spherical and provide one example of the sort of item that can serve as a ball. Small hollow containers are often used in novelty vending machines and provide another such example. These hollow containers sometimes comprise two generally hemispherical shells interfitted along an equator to form a quasi-spherical ball having an equatorial seam or seam belt 9 disposed thereabout. In extreme cases, the hollow novelty item container may be clearly ovoid in shape and may have a visibly thick belt where two shells join to close the package. These may all be used as balls in the apparatus of the invention inasmuch as they can be induced to roll down a slanted surface into a delivery chute of some sort. Moreover, in some embodiments of the invention an article of merchandise, hereinafter referred to as a "prize" is dispensed to a user responsive to a target being hit by a vended ball. In some embodiments, these prizes are configured as balls, but in most cases, as will be elucidated in greater detail hereinafter, the prizes, if packaged, are packaged in non-spherical containers and are delivered to the player by different means than used for the vended balls.

Figure 1:
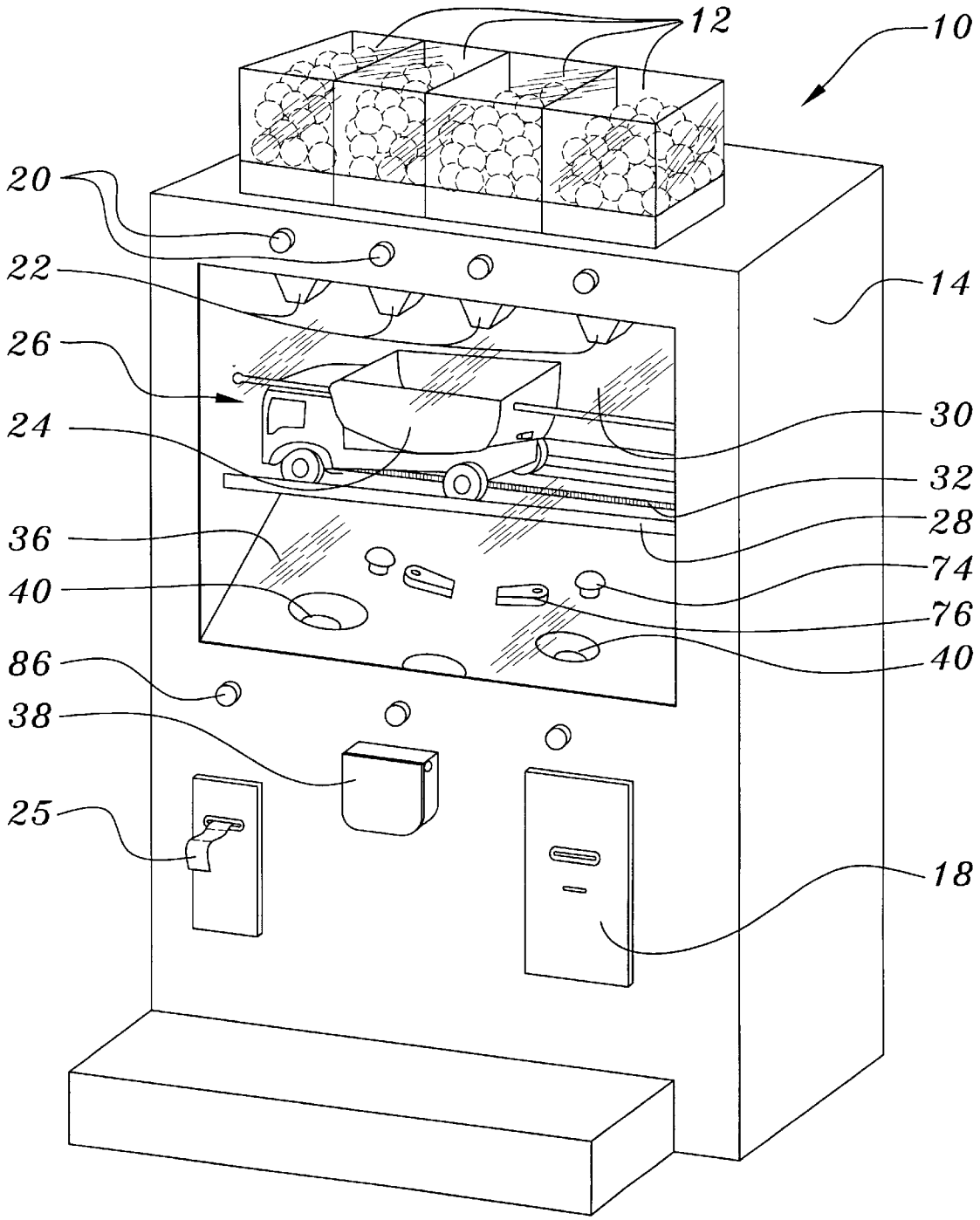
FIG. 1 is a perspective elevational view of an apparatus of the invention.
Figure 2:
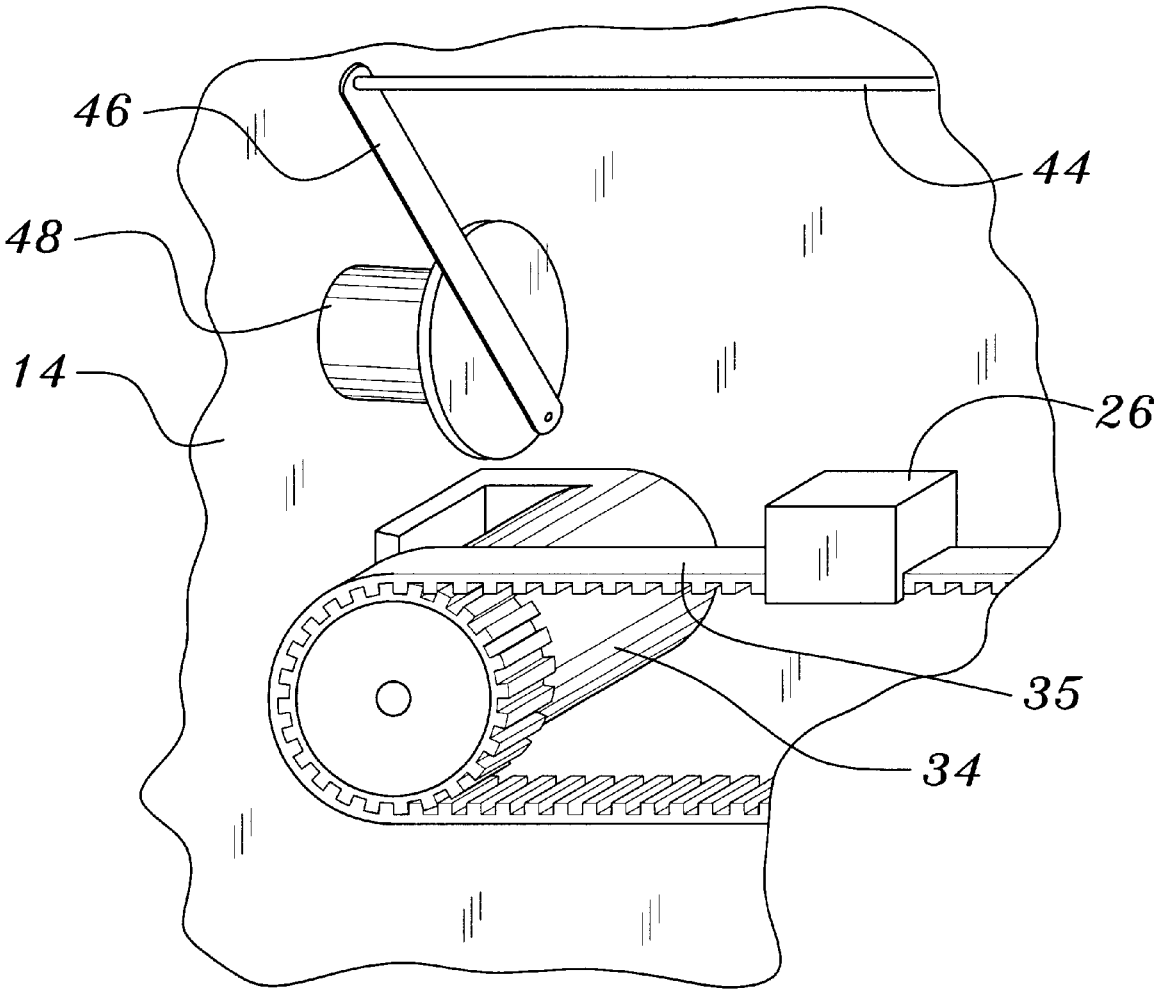
FIG. 2 is a detail view of components used to control the motion of an intermediate carrier portion of the embodiment of FIG. 1.

Turning now to FIG. 1, one finds an embodiment of the invention 10 having a plurality of hoppers 12 juxtaposed along the top of an enclosure 14, where each hopper has some sort of dispensing mechanism 16 operatively associated therewith. A ball 8 can be selectively dispensed from one of the hoppers 12 by a player who whose play-initiating actions may comprise inserting currency, coins, tokens, or other suitable means of payment 17 into an acceptor 18 and then pushing a hopper-select button 20. It may be noted that such arrangements using a single acceptor 18 to control dispensing from a plurality of ball hoppers 12 are well known and may be used as a component portion of the apparatus of the invention 10. One example of such a multi-hopper dispensing arrangement is the "EBV Slimline" made by A&A Global of Timonium, Md. It may also be noted in the foregoing that although the use of a plurality of transparent hoppers is preferred to provide the player with a selection of merchandise, the invention could function with hoppers having opaque walls, with an article dispenser or dispenser other than a hopper, or with a single hopper.

In the embodiment depicted in FIG. 1, a ball 8 vended from one of the hoppers 12 may fall out of a hopper chute 22 into an intermediate carrier 24 which may be configured as the dump bed of a toy truck 26. In a preferred embodiment, the toy truck 26 is disposed on rails 28 running across the front of the enclosure 14 behind a front window 30 and is driven back and forth along the rails 28 whenever the apparatus 10 is turned on and awaiting a player. In a preferred embodiment, this reciprocating motion is provided by a reversing electric motor 34 driving a transversely ribbed flexible belt 35 of the type commonly used as a timing belt in automotive engines. The motion can also be provided by various known means such as connecting the truck 26 to a feed screw 32 that changes the direction of motion each time the truck hits a limit switch (not shown) adjacent either end of the rails 28. Moreover, there are several arrangements for dispensing a ball 8 into the intermediate carrier 24. One could juxtapose the outputs of hopper chutes 22 close together near one side of the enclosure 14 and controllably pause the reciprocating motion of the toy truck 26 adjacent that side whenever payment was accepted by the acceptor 18. In a preferred arrangement, however, there is a limit switch operatively associated with each of a plurality of hoppers, the limit switches arranged so that the truck 26 stops directly beneath the selected hopper chute 22. At the other extreme, the hopper chutes 22 could be spaced apart near the front of the enclosure and the apparatus could be configured to keep the truck in motion during dispensing. In this case, some of the vended balls would miss the intermediate carrier 26, would fall onto a lower portion of a slanted playing surface 36 and would roll into a delivery chute 38 with little chance of striking a target 40.

A preferred intermediate carrier 24 of the invention is vertically spaced apart from the hopper chute(s) 22 by a great enough distance that the ball 8 can be seen by a player looking through the window 30. Having the ball 8 visible while in the intermediate carrier 24 can aid the player in his or her attempt to selectively position the ball 8 on the playing surface 36 so as to maximize the chance of having the ball 8 strike or fall into a target 40.

In the embodiment of FIG. 1, the intermediate carrier 24 simulates some sort of vehicle body used for carrying and dumping loads. Although this is depicted as being a toy dump truck 26, it will be understood that other such vehicles, such as the combination of a toy locomotive and a bulk carrier rail car (not shown) could equally well be used. In the depicted embodiment, the dump body 42 is pivotally attached to the chassis of the toy truck 26 and the combination of a rod 44, crank arm 46 and electric dumping motor 48 is used to tilt and reset the dump body 42 during a single rotation of the dumping motor 48. This dumping arrangement ejects the ball 8, which lands on an upper portion 50 of the slanted surface 36 and rolls down the surface until it ultimately falls into the delivery chute 38.

A player's chance of having his or her vended ball 8 strike a target 40 is, of course, maximized if the ball begins its travel along the playing surface 36 in a position generally above one of the targets 40. Hence, in the embodiment of FIG. 1, choosing when and where the dumping operation is to be done is an important part of the game. In a preferred embodiment, the player watches the toy truck 26 move to and fro and, when the ball 8 in the dump bed 42 is appropriately aligned with a target 40, hits a "dump" button 52, which initiates the dumping sequence. It will be understood to those skilled in the art that the degree of difficulty in picking an appropriate dump point can be controllably varied by the manufacturer of the apparatus 10 by the selection of the shape of the dump body 42, the deceleration rate selected for stopping the reciprocating motion, the speed of the dumping motor operation, etc.

Figure 4:
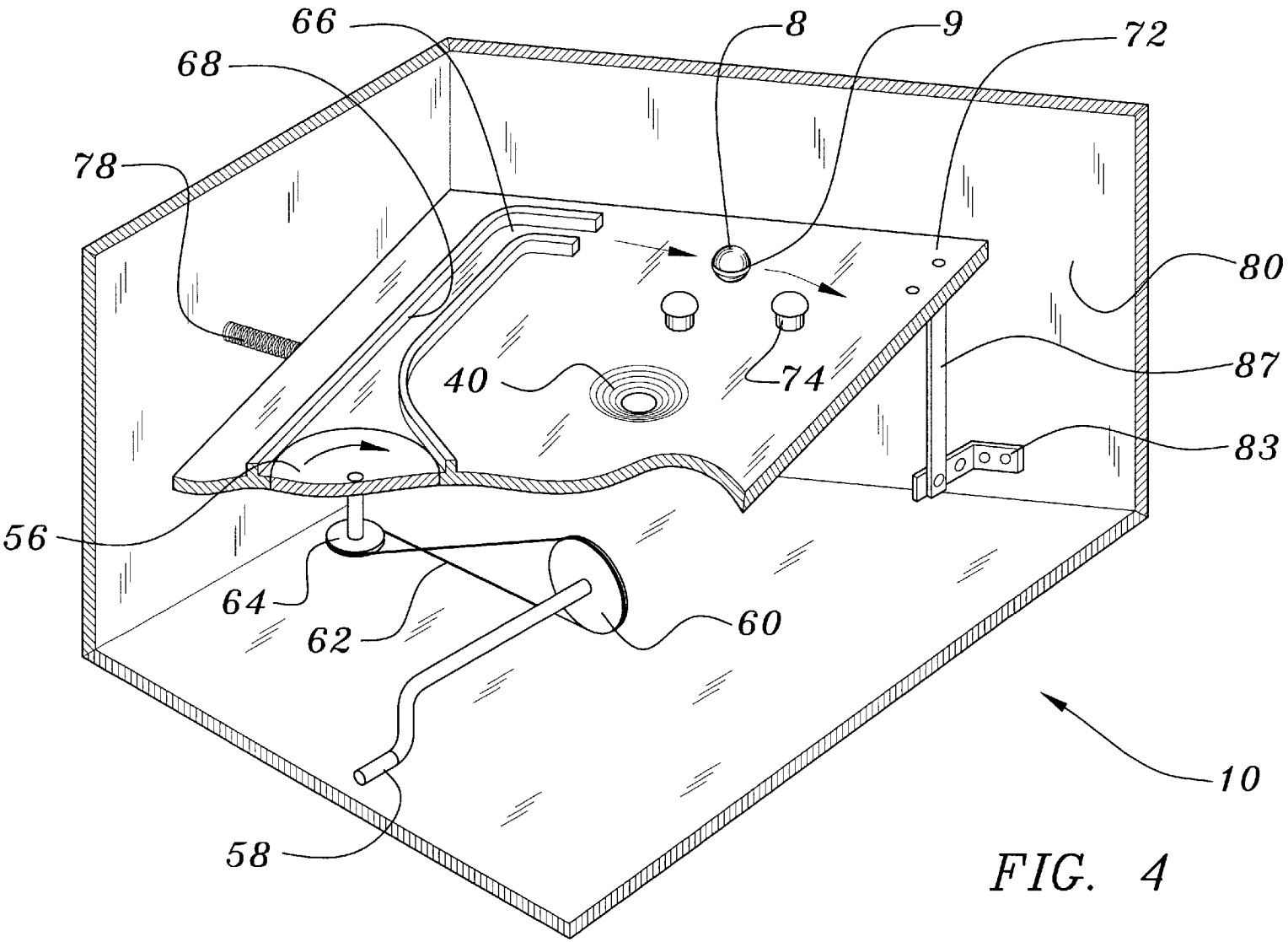
FIG. 4 is a partial, cut-away, perspective view depicting an alternative embodiment of the invention.

Turning now to FIG. 4, one finds a second embodiment of the invention in which a rotatable circular element 56 serves as the intermediate carrier 24. In this embodiment the ball 8 is initially vended onto the rotatable surface 56 from an array of hoppers 12 and chutes 12, as discussed above with respect to FIG. 1. The player then spins the rotatable surface 56 (e.g., by means of the depicted combination of a crank 58, a drive wheel 60, a twisted belt 62 and a driven wheel) until the rotatable surface spins fast enough that the ball is thrown, by centrifugal forces, through the output chute 66 onto an upper portion of the playing surface 36. In a preferred embodiment, the rotatable surface is tilted away from the horizontal somewhat so as to ensure a higher speed of ejection. To some extent, the speed of ejection is controlled by the player who thereby controls the trajectory of the ball along the upper portion of the playing surface 36. Although not shown, it will be clear to those skilled in the art that the output chute 66 is defined by a upstanding wall 68 that wraps around the rotatable surface to form a collar that prohibits the ball 8 from being ejected in other than the desired direction.

In either of the depicted embodiments the ball 8 is deposited on the playing surface 36 by some means that a player can at least partially control so as to improve his or her chance of having the ball 8 strike a target 40. After being deposited, the ball 8 rolls downwardly along the slanted surface 36 and ultimately falls into a delivery chute 38. As generally shown in FIG. 4, this may occur by the ball's falling through a target 40 (which is preferably shaped like the bell of a brass instrument), landing on the sloping floor 70 of the enclosure 14, and rolling downwards into the chute. Balls that miss all the targets 40 eventually fall off a lower, front edge 72 of the playing surface and roll into the chute.

Figure 6:
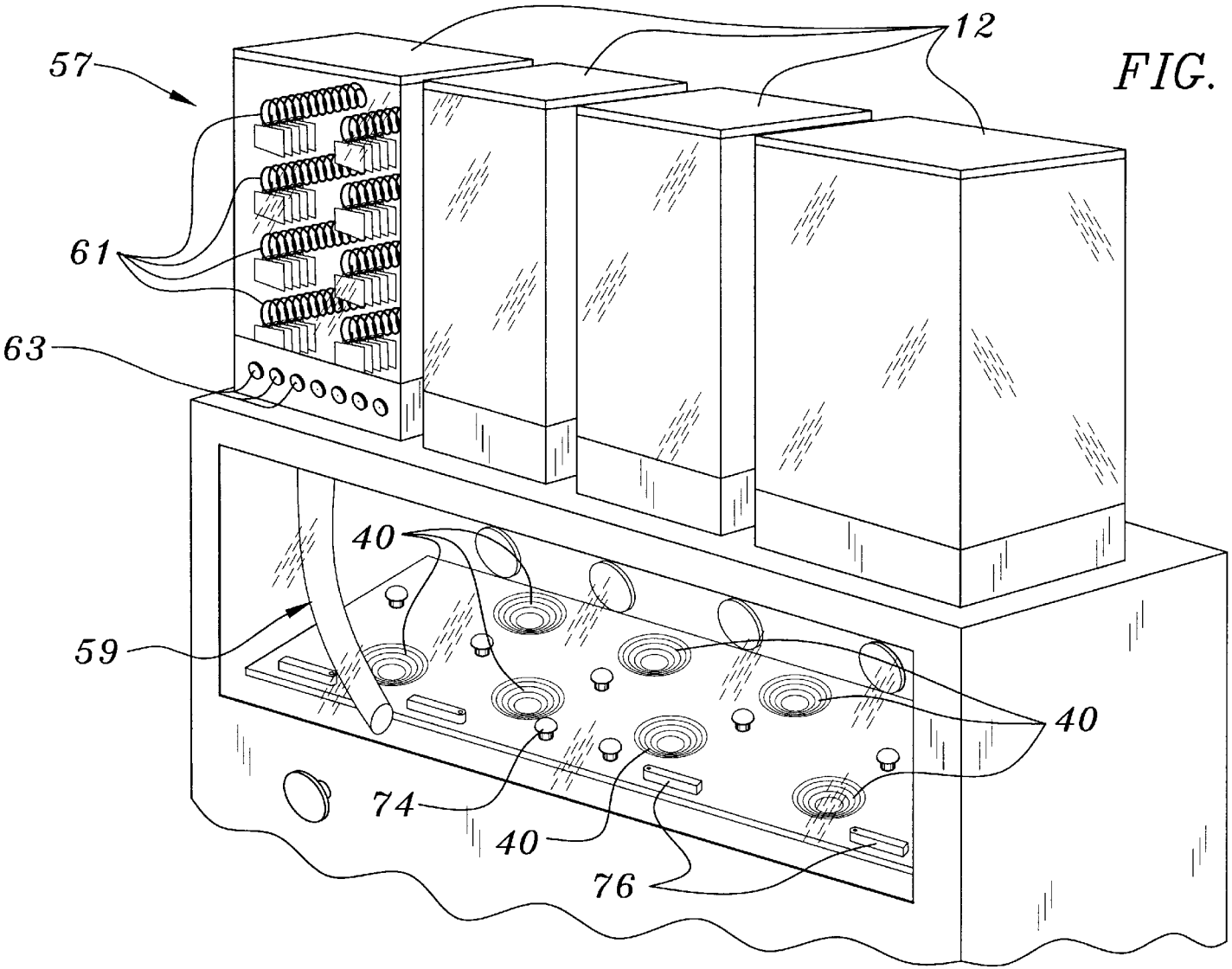
FIG. 6 is a perspective elevational view depicting a second embodiment of a crediting means of the invention.

Thus, each time a player uses the apparatus of the invention 10 a generally spherical item which may be a container holding a purchasable object, is vended to the player. In preferred embodiments the use of a plurality of ball hoppers 12 provides the player with a choice as to which product is vended. Moreover, on each play the player has a chance to receive a credit or award from some sort of crediting means 45 that acts responsive to the vended ball 8 striking a target 40. There are, of course, numerous possibilities for the award. In the embodiment depicted in FIG. 1, for example, a ticket dispenser 25 dispenses one or more tickets to the player, with the number of tickets dispensed depending on which of the targets was hit. As is known in the arcade game business, the ticket or tickets can be accumulated by the player until he or she has enough to exchange the aggregated set of tickets for a desired thing of value obtained from the arcade operator. The embodiment depicted in FIG. 6, on the other hand, provides either an immediate or cumulative means for dispensing a selected prize to the successful player. In one arrangement of this sort the player is offered a choice from several different prizes that correspond to the value of whatever target 40 his vended ball 8 struck. This can be done, for example, by placing a suitable prize vending apparatus 57 having a separate prize dispensing chute 59 adapted to drop the selected prize directly into the delivery chute 38 rather than dropping the selected prize onto the playing surface 36. The prize dispensing apparatus 57 may be one of the sort adapted to visually display available prizes hanging from ones of a plurality of "corkscrews" 61, as depicted in FIG. 6, although it will be recognized to those skilled in the art that many other sorts of item dispensers may be used. In the embodiment depicted in FIG. 6, each of the corkscrews 61 is associated with one of a corresponding plurality of "winner select" buttons 63 or other suitable means whereby the apparatus is adapted to respond to a prize-selecting action of the player. Depending on the value of the target that has been hit, various of these buttons 63 may be illuminated to show the player which prizes can be selected. As is known in the art, this arrangement may be employed in a cumulative scoring fashion in which the values of "hits" made on successive plays are added up and a button 63 or buttons corresponding to the aggregate credit due the player can be illuminated. This embodiment of the invention thus combines vending a selected item each time a player deposits a predetermined payment, providing a game of skill and chance played with the vended item during the course of its delivery, awarding and accumulating credits for successful play or plays of the game, and vending a player-selected prize that is one of several displayed prizes corresponding to the player's accumulated or aggregated credit.

Figure 3:
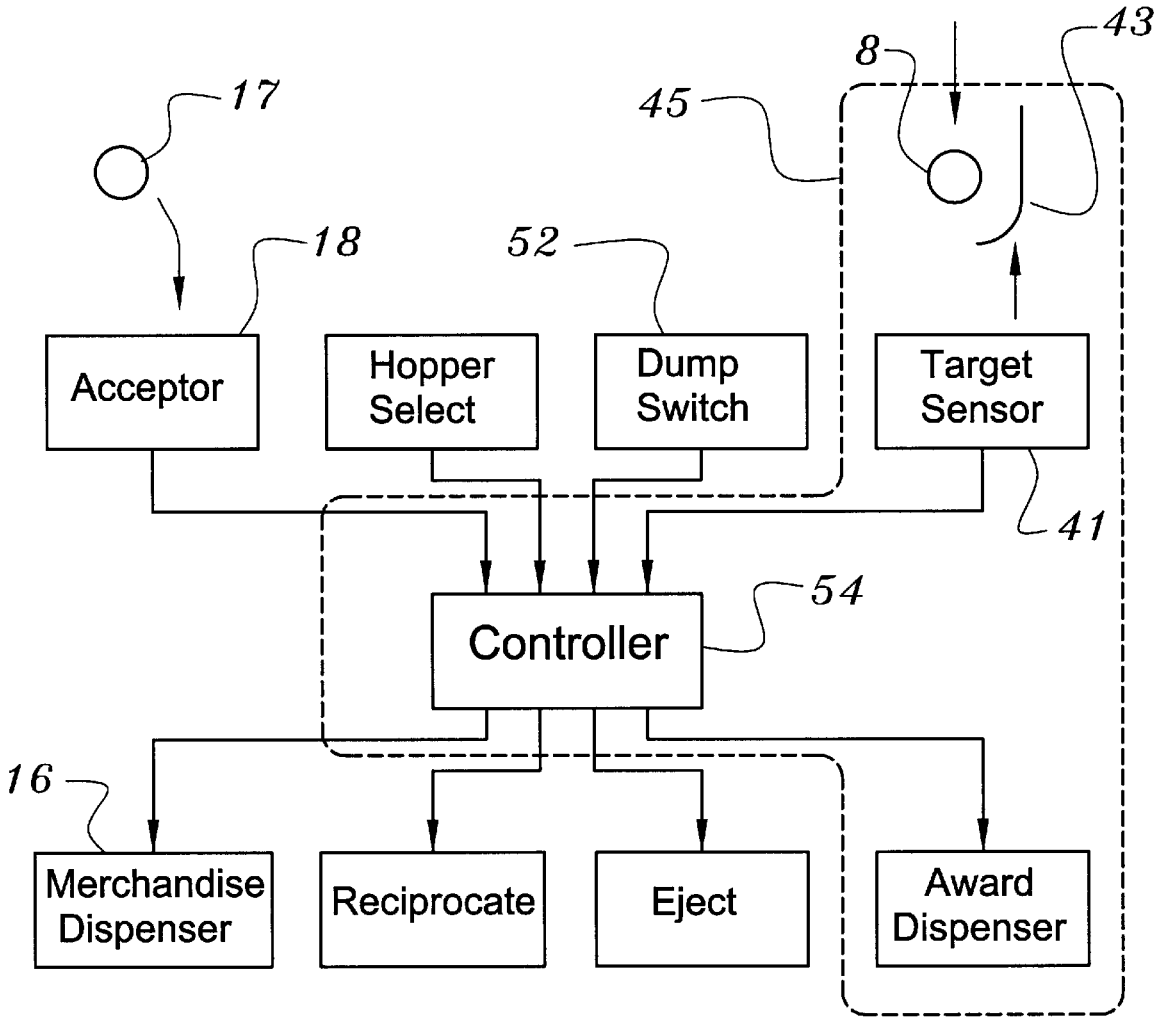
FIG. 3 is schematic block diagram of a control system usable with apparatus of the invention.

One approach to controlling apparatus of the invention is depicted schematically in FIG. 3. A controller 54, which may be a microprocessor operating under control of a stored program, is adapted to receive inputs from an acceptor 18, hopper select switches 20, a dump button 52 and one or more target sensors 41 having appropriate outputs when the ball contacts the target. The sensors 41 may be micro-switches tripped by a ball 8 falling through a horn-like target 40. Responsive to these inputs, the controller 54 operates a merchandise dispenser 16 to dispense a ball 8, optionally controls the reciprocation of an intermediate carrier 24 and the ejection of the ball therefrom, and awards whatever credit is won. Although FIG. 3 depicts the major inputs, outputs and control functions performed by apparatus of the invention, it will be recognized by those skilled in the art that many other approaches may be used. For example, in the initial development of apparatus of the invention 10, the acceptor 18, hopper select switches 20 and merchandise dispensing equipment were procured as a single subsystem and the balance of the control system comprised an arrangement of switches, relays, timers, and electromechanical actuators.

As hereinbefore noted, the game played with apparatus of the invention has some similarities to the well known game of pinball. Correspondingly, many of the same objects and mechanisms, such as bumpers 74 and flippers 76, may be provided on the playing surface 36. A significant difference between the present game and pinball is that apparatus of the invention is to be used with balls that are both lighter and less regular in shape than are the well-formed steel balls commonly used in a pinball game. Because of these differences, a ball 8 used in apparatus of the invention is much more likely to "hang" on a bumper or otherwise come to rest on the playing surface. One solution to this is to use a playing surface that is tilted with respect to the horizontal by a greater degree than is used for a pinball table so that the balls experience greater gravitational forces in rolling down the surface 36 (e.g., a degree of tilt comparable to that indicated in the view of FIG. 1). This, however, can lead to unpleasantly short playing times when the ball rolls well, and does not fit in well with the desired size and shape of the overall game.

Figure 5:
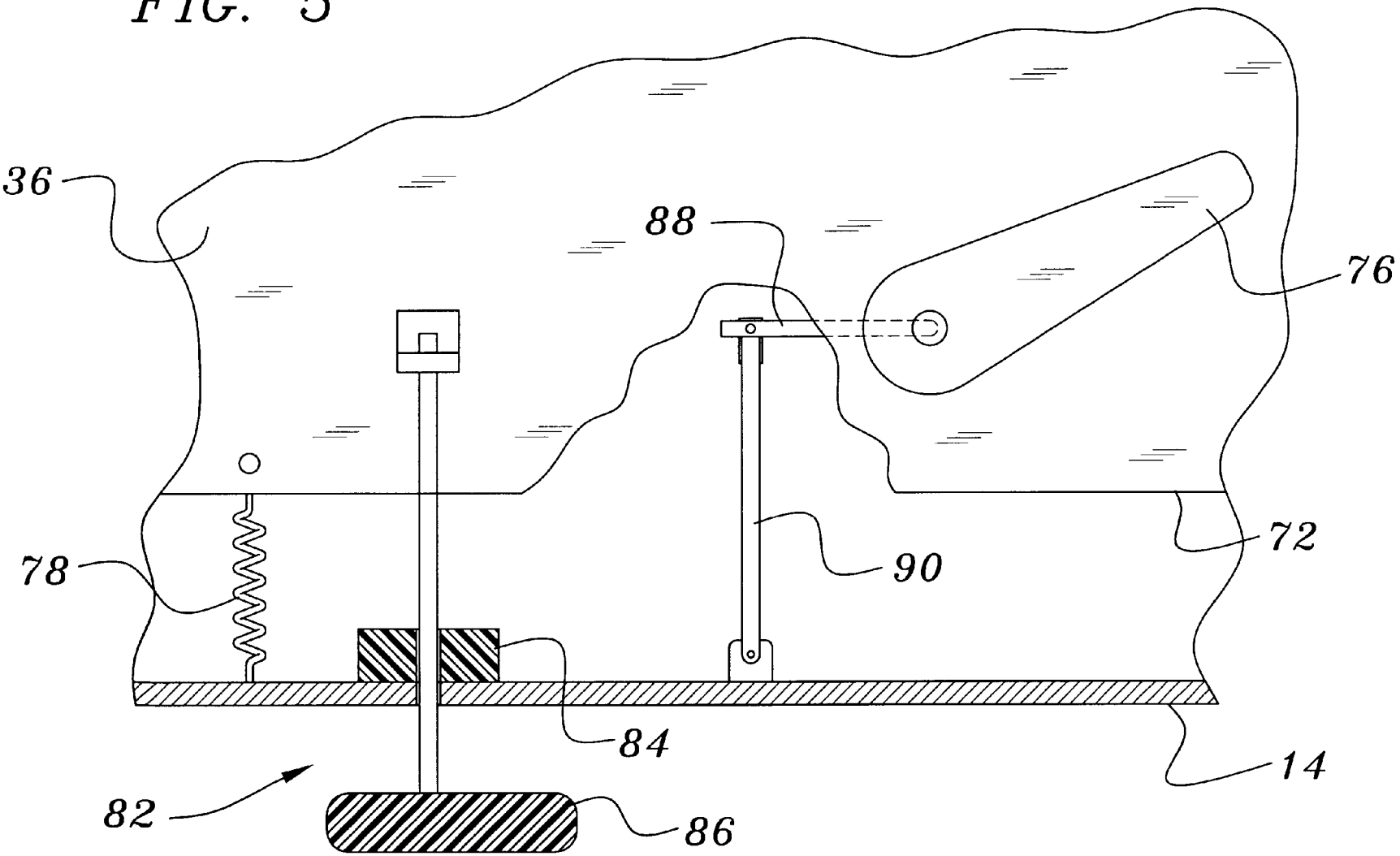
FIG. 5 is a horizontal sectional detail view of a player control used in the embodiment of FIG. 3

A preferred solution to this difficulty is provided by giving the player means to move the playing surface and to thereby re-start a ball that has stopped rolling. As depicted in FIGS. 4 and 5, this may be done by using a "floating" playing surface that is attached to the walls or floor of the enclosure 14 by suitable resilient means that allow the surface 36 to be moved to and fro short distances. In a preferred embodiment, the back, upper, portion 50 of the playing surface is attached to the back wall 80 of the enclosure by means of a vertical bar 81 pivotally attached to a bracket 83. A combination of "nudgers" 82 and springs 78 is used to attach the lower, front, edge 72 of the playing surface to the housing 14. As depicted in FIG. 5, a preferred nudger has one end fixedly attached to the playing surface 36 and the other end protruding outwardly through a bearing 84 attached to the front wall of the enclosure 14. In use, a player can nudge the playing surface 36 rearwardly by pushing on either or both of a pair of nudge knobs 86 disposed on either side of the front of the housing 14.

In a preferred embodiment the flipper 76 is actuated when a player strikes a nudge knob 86. As depicted in FIG. 5, a preferred flipper 76 comprises a tab 88 that is connected to the housing 14 by means of a connecting rod 90 movably retained at both its ends. Thus, when the player pushes the nudge knob 86 toward the back of the housing, the flipper 76 moves so as to strike a ball 8 and drive it back up the playing surface that it has just rolled down.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is claimed is:

1. Apparatus for a game wherein a ball is delivered to a player on each play and wherein a credit is awarded to the player only if the ball contacts a target, the apparatus comprising:

a ball hopper adapted to retain a plurality of the balls;

dispensing means adapted to dispense one of the balls from the hopper responsive to a first action of a player, the dispensing means comprising an outlet from which the dispensed ball falls under the influence of gravity;

an intermediate carrier disposed beneath the dispensing means and spaced apart therefrom;

a window adjacent the carrier, the window disposed so that the intermediate carrier is visible from a player's position;

ejection means adapted to eject the ball from the intermediate carrier onto an upper portion of a slanted playing surface responsive to a second action of the player, the target disposed on the playing surface;

crediting means operatively associated with the target, the crediting means adapted to award the credit if the ball contacts the target; and a delivery chute disposed below the playing surface, the delivery chute adapted to deliver the ball to the player.

2. The apparatus of claim 1 wherein the intermediate carrier is adapted to visually simulate a vehicle and the ejection means is adapted to simulate dumping a load from the vehicle.

3. The apparatus of claim 1 wherein the intermediate carrier comprises a rotatable surface and the ejection means comprises a player-controlled means for rotating the rotatable surface.

4. The apparatus of claim 1 wherein the target comprises a hole in the slanted playing surface.

5. The apparatus of claim 1 wherein the playing surface is attached to a housing by means of springs that bias the playing surface into a first position, the apparatus further comprising means operable by the player to move the playing surface out of the first position.

6. The apparatus of claim 1 further comprising a plurality of targets, wherein the crediting means is adapted to award a first credit if the ball contacts a first of the targets and to award a second credit if the ball contacts a second of the targets.

7. Apparatus for a game wherein a ball is delivered to a player on each play and wherein a credit is awarded to the player only if the ball contacts a target, the apparatus comprising:

a ball hopper adapted to retain a plurality of balls;

dispensing means adapted to dispense one of the balls from the hopper responsive to a first action of a player, the dispensing means comprising an outlet from which the ball falls under the influence of gravity;

an intermediate carrier simulative of a vehicle, the intermediate carrier disposed beneath the dispensing means;

carrier reciprocation means adapted to move the carrier horizontally;

ejection means operatively associated with the intermediate carrier and adapted to eject the ball from the carrier onto an upper portion of a slanted playing surface responsive to a second action of the player, the target disposed on the playing surface;

crediting means operatively associated with the target, the crediting means adapted to award the credit if the ball contacts the target; and a delivery chute disposed below the playing surface, the delivery chute adapted to deliver the ball to the player.

8. The apparatus of claim 7 wherein the reciprocation means comprises an electric motor adapted to drive a drive belt.

9. The apparatus of claim 7 wherein the intermediate carrier simulates a dump truck and wherein the ejection means comprises an electric motor and a crank arm adapted to lift that side of a simulative dump truck load bed distal from a hinge joint connecting the simulative load bed to a simulative truck chassis.

10. The apparatus of claim 7 wherein the playing surface is attached to a housing by means of springs that bias the playing surface into a first position, the apparatus further comprising means operable by the player to move the playing surface against a restoring force of the springs.

11. The apparatus of claim 7 further comprising a first predetermined number of targets, a corresponding first predetermined number of crediting means, and a second predetermined number of credits, wherein a first crediting means operatively associated with a first of the targets is adapted to award a first of the credits and wherein a second crediting means operatively associated with a second of the targets is adapted to award a second of the credits.

12. Apparatus for a game wherein a ball is delivered to a player on each play and wherein a credit is awarded to the player only if the ball contacts a target, the apparatus comprising:

a ball hopper adapted to retain a plurality of the balls;

dispensing means adapted to dispense one of the balls from the hopper responsive to a first action of a player, the dispensing means comprising an outlet from which the ball falls under the influence of gravity;

an intermediate carrier disposed beneath the dispensing means, the intermediate carrier comprising a rotatable surface;

rotation means controlled by the player to rotate the rotatable surface and to eject the ball therefrom onto an upper portion of a slanted playing surface whereon the target is disposed;

crediting means operatively associated with the target, the crediting means adapted to award the credit if the ball contacts the target; and a delivery chute disposed below the playing surface, the delivery chute adapted to deliver the ball to the player.

13. The apparatus of claim 12 wherein the rotation means comprises a crank adapted to be turned by the player.

14. The apparatus of claim 12 wherein the playing surface is attached to a housing by means of a spring biasing the playing surface into a first position, the apparatus further comprising means operable by the player to move the playing surface out of the first position against the biasing force of the spring.

15. The apparatus of claim 12 wherein the playing surface further comprises an upstanding wall disposed about a portion of the rotatable intermediate carrier, the upstanding wall defining a chute adapted to conduct the ball from the rotatable intermediate carrier to an upper portion of the playing surface.

16. The apparatus of claim 12 further comprising a first predetermined number of targets and a corresponding first predetermined number of crediting means and a second predetermined number of credits, wherein a first crediting means operatively associated with a first of the targets is adapted to award a first of the credits and wherein a second crediting means operatively associated with a second of the targets is adapted to award a second of the credits.

17. Apparatus for a game wherein a ball is delivered to a player on each play, the apparatus comprising:

a hopper adapted to retain a plurality of the balls and to dispense one of the balls onto an upper portion of a slanted playing surface responsive to a play-initiating action of a player;

a target disposed on the slanted playing surface a target sensor associated with the target, the target sensor having an output if the ball contacts the target;

a crediting means adapted to award a credit to the player responsive to the target sensor output;

a prize dispensing apparatus adapted to dispense a prize associated with the awarded credit responsive to a prize-selecting action of the player; and a delivery chute disposed below the playing surface, the delivery chute adapted to receive the one of the balls and to deliver the one of the balls to the player.

18. The apparatus of claim 17 wherein the playing surface is attached to a housing by means of a spring biasing the playing surface into a first position, the apparatus further comprising means operable by the player to move the playing surface out of the first position against the biasing force of the spring.

19. The apparatus of claim 17 wherein the prize dispensing means is adapted to display each of a plurality of prizes and to drop that one of the prizes associated with the awarded credit into the delivery chute.

20. The apparatus of claim 17 further comprising a plurality of targets, each of the targets having a respective target sensor associated therewith, wherein the crediting means is adapted to award a first credit if the ball contacts a first of the targets and a second credit if the ball contacts a second of the targets.

21. The apparatus of claim 17 wherein the crediting means is adapted to aggregate the credits associated with each of a plurality of play-initiating actions and wherein the prize dispensing apparatus is adapted to dispense a prize associated with the aggregated awarded credit.

22. The apparatus of claim 17 wherein the target sensor comprises a micro-switch, the credit awarding means comprises a microprocessor operating under control of a stored program and wherein the prize dispensing apparatus is adapted to visually display the prize and to deliver the prize directly to the delivery chute.

* * * * *